US009370078B2

(12) United States Patent
Feri et al.

(10) Patent No.: US 9,370,078 B2
(45) Date of Patent: Jun. 14, 2016

(54) LIGHTING SYSTEM

(75) Inventors: Lorenzo Feri, Eindhoven (NL); Theodorus Jacobus Johannes Denteneer, Eindhoven (NL); Johan Cornelis Talstra, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 439 days.

(21) Appl. No.: 13/810,905

(22) PCT Filed: Jul. 18, 2011

(86) PCT No.: PCT/IB2011/053179

§ 371 (c)(1),
(2), (4) Date: Jan. 18, 2013

(87) PCT Pub. No.: WO2012/011038

PCT Pub. Date: Jan. 26, 2012

(65) Prior Publication Data

US 2013/0119892 A1 May 16, 2013

(30) Foreign Application Priority Data

Jul. 21, 2010 (EP) ..... 10170221
Sep. 15, 2010 (EP) ..... 10176732

(51) Int. Cl.

| | |
|---|---|
| ***G03F 1/00*** | (2012.01) |
| ***H05B 37/02*** | (2006.01) |
| ***H05B 39/04*** | (2006.01) |
| ***H05B 41/36*** | (2006.01) |

(52) U.S. Cl.

CPC ..... *H05B 37/0209* (2013.01); *H05B 37/0263* (2013.01)

(58) Field of Classification Search

CPC ..... H05B 37/029; H05B 37/02; H05B 41/42; F21W 2131/406; G05B 19/14

USPC ..... 315/150, 293, 294

See application file for complete search history.

(56) References Cited

U.S. PATENT DOCUMENTS

| | | | | |
|---|---|---|---|---|
| 7,088,423 | B2 * | 8/2006 | Akiyama | G03F 7/2028 355/53 |
| 7,566,987 | B2 | 7/2009 | Black et al. | |
| 2007/0014113 | A1 | 1/2007 | Von Der Brelie | |
| 2007/0288784 | A1 | 12/2007 | Koper et al. | |
| 2009/0049315 | A1 | 2/2009 | Diab et al. | |
| 2009/0112373 | A1 | 4/2009 | Feldman et al. | |
| 2010/0039043 | A1 | 2/2010 | Wacknov et al. | |

FOREIGN PATENT DOCUMENTS

| | | | |
|---|---|---|---|
| CN | 101331840 | A | 12/2008 |
| JP | 2004178936 | A | 6/2004 |
| JP | 2005123081 | A | 5/2005 |
| JP | 2007234427 | A | 9/2007 |
| JP | 2008103322 | A | 5/2008 |
| WO | 2008134433 | A1 | 11/2008 |
| WO | 2010097742 | A1 | 9/2010 |

* cited by examiner

*Primary Examiner* — Diana J Cheng
(74) *Attorney, Agent, or Firm* — Meenakshy Chakravorty

(57) ABSTRACT

There is provided a lighting system 100 comprising at least one lighting device 110, 120, 130 and a control unit 140 arranged for providing power $P_{1,2,3}$ to each lighting device according to a control logic which is based on startup characteristics $C_{1,2,3}$ of each lighting device. Thereby a lighting system is provided in which the individual characteristics of the lighting devices are taken into account when controlling the lighting devices. Since the control logic is based on startup characteristics for the lighting devices in the system, as an example, a reduction of the total standby power in the lighting system is achievable.

15 Claims, 1 Drawing Sheet

LIGHTING SYSTEM

FIELD OF THE INVENTION

The present invention relates generally to a lighting system comprising at least one lighting device, and more particularly a lighting systems comprising a control unit for providing power to each lighting device according to a control logic.

BACKGROUND OF THE INVENTION

In conventional lighting systems and lighting devices like luminaires, it is common to put the light sources in a standby mode, when they are not in use. While in standby mode, the lighting devices are capable of a limited functionality. The most important functionality is listening to upcoming control commands that may request the lighting device to wake up and go to normal drive mode.

WO2008/134433 discloses a lighting system in which an Ethernet computer network is used to provide power to one or more lighting devices that are connected directly to the Ethernet. The system utilizes the IEEE standard Power over Ethernet (PoE). The lighting devices may include light emitting diodes (LEDs), fluorescent lamps, high-intensity discharge (HID) lamps and/or exit signs. By providing power to the lighting devices via the Ethernet, a separate connection to a power supply for the lighting device is not necessary. One Ethernet cable is thus applicable for transporting both data and power in the lighting system. Further, to save energy a zero standby power can be realized for an individual lighting device by switching off its corresponding Ethernet port which is utilized for providing the power. A computer, through the Ethernet, monitors and controls when lighting devices should be turned off to conserve energy when the lighting is not required, such as after-hours, etc. Further functionality like timed lighting can also be controlled by the computer.

While the system described above is generally effective in accomplishing its purpose, it requires a large and complex infrastructure, and an omniscient management computer. Further, the system is a quite blunt tool in handling standby and startup of lighting devices in which different driving is required in particular when employing a plurality of different types of light sources in the lighting devices of the lighting system. This may result in unsynchronized control of the lighting in a room and the occurring of annoying time delays in the lighting of the lighting devices.

SUMMARY OF THE INVENTION

It is an object of the present invention to provide an improved lighting system that alleviates at least one of the above-mentioned drawbacks of the prior art.

This object is achieved by a lighting system and a method according to the present invention as defined in the appended independent claim. Preferred embodiments are set forth in the dependent claims and in the following description and drawings.

Thus, in accordance with a first aspect of the present invention, there is provided a lighting system comprising a managing computer arranged to provide control commands to at least one lighting device via a control unit, wherein the control unit is arranged to adapt a control logic for providing power to the at least one lighting device based on a startup characteristic of the at least one lighting device.

Thereby, a lighting system is provided in which the individual startup characteristics of the lighting devices are taken into account when controlling the lighting devices. This is advantageous since typically startup characteristics for different lighting devices can differ significantly. Since the control logic is based on startup characteristics for the lighting devices in the system, as an example, a reduction of the total standby power in the lighting system is achievable. In this example the control unit has information regarding which lighting devices have capability of an instantaneous switching when going from an off-state to an on-state, and which lighting devices will have to be preheated or e.g. ramped up previous to switching from an off-state to an on-state. Thus, the lighting devices with faster switching do not need to be put on a standby power. Since standby power is provided only to specific lighting devices the lighting system becomes less energy consuming. Furthermore, since the control logic is arranged based on the startup characteristics it may be arranged to synchronize the lighting up of the lighting devices, such that a smooth, synchronous startup of the lighting in a premises is achieved.

Further, the present inventive concept allows for that the control unit and control logic may be implemented locally in a premises which is advantageous especially in the case of lighting. That is, in practice at some level, lighting control is often local, i.e. a sensor or switch triggers a lighting device in a room or corridor. The lighting devices are arranged in the vicinity of this sensor or switch. The present lighting system which comprises a control unit that is aware of the lighting devices startup character is thus suitable for extending an existing lighting system. Implementation in new areas with specific lighting arrangements may advantageously be done, without the need for upgrading an over the whole building extending lighting system. In a case when a central managing computer controls light in a building, the inventive lighting system allows for the central computer to only send a single command for a particular lighting device, e.g. "switch to an on-state", "switch to an off-state", "be ready to switch to an on-state" etc., while the detailed commands regarding the startup characters for an individual lighting device is controlled by the control unit. This provides for a flexible lighting system, which is capable of managing different types of lighting devices, and which is easy to extend, since information regarding the actual lighting devices being installed is handled locally at the control unit.

In accordance with an embodiment of the lighting system, the control unit is further arranged for providing control data to each lighting device and the control logic is further arranged for controlling the control data.

In accordance with an embodiment of the lighting system, the respective startup characteristics are associated with a respective startup time for switching on each lighting device. An important startup characteristic is the startup time for the lighting device. Lighting devices comprising Light Emitting Diodes, LEDs, have a quick startup time in comparison with e.g. HID-lamps. Thus, a lighting device comprising LEDs may be completely turned off and does not have to be set in a standby mode. Other lighting devices which comprise e.g. HID lamps, require to be set in a standby mode long before the moment they actually are instructed to be switched on.

In accordance with an embodiment of the lighting system, the control unit is arranged to receive power from an external power source. Thereby, the control unit can be implemented locally.

In accordance with an embodiment of the lighting system, the control unit is arranged to retrieve the respective startup time for each lighting device by means of measuring the startup time of each lighting device. Thereby, any type of lighting device may be implemented in the system. The control logic utilizes the measured startup time for each lighting device, and may then adjust the power setting for different drive modes according to the requirements for the lighting device.

In accordance with an embodiment of the lighting system, the startup characteristics are retrieved by prompting each lighting device, or by retrieving the startup characteristics for each lighting device from an external source. The lighting device itself may be provided with information regarding its startup characteristics, which information it provides to the control unit. Another possibility is that the control unit retrieves the startup characteristics from an external source, like a computer, e.g. when commissioning the system. This allows for simpler communication abilities in the lighting device.

In accordance with an embodiment of the lighting system, when retrieving the startup characteristics from an external source, the system is arranged to receive a message comprising the startup characteristics, which message is constructed according to a lighting protocol (such as f.i. DMX, DALi, etc), or the system is arranged to receive a message comprising a reference to a location where the startup characteristics can be retrieved. Thus, either the startup characteristics are communicated directly in a message, or alternatively a reference, e.g. an URL, is communicated to the control unit to indicate where the information may be retrieved. The latter having the advantage that the message length becomes shorter than when sending all startup characteristics in the message.

In accordance with an embodiment of the lighting system, the control logic is arranged for, if the control unit receives an alert, switching each lighting device into a first drive mode, or if a predetermined first time setting is satisfied switching each lighting device into a second drive mode, or if a predetermined second time setting is satisfied switching each lighting device into a third mode. Different drive modes may thus be employed for different times of the day. The alert may origin from e.g. a motion detector. The motion detector may be arranged for detecting movement at a workstation in a room, in which case the desk lamp should be turned on. The predetermined time settings may relate to, for instance, working hours and after-hours. These are time periods during which lighting requirements in premises are different. The time setting may alternatively be controlled by a timer which is triggered by an event. As an example, if a person was present in a room during night time and was detected by means of a motion detector, a lighting device may be set in a standby mode during a predefined time to be prepared in case the person returns, before returning to an off state (corresponding to f.i. the mode selected for a time setting indicating night time or after-hours). The predefined time may depend on the startup characteristics of the lighting device(s) involved.

In accordance with an embodiment of the lighting system, the control logic is further arranged such that for the first mode, power is provided to each lighting device, for the second mode and for each lighting device having a first type of startup characteristics no power is provided to that lighting device, for the second mode and for each lighting device having a second type of startup characteristics at least some power is provided to that lighting device, and for the third mode no power is provided to each lighting device. Here the second mode may be a standby mode where the first type of startup characteristics represents fast switching lighting devices, while the second type of startup characteristics represent slow switching lighting devices. Slow switching lighting devices are thus provided with a respective applicable standby power.

In accordance with an embodiment of the lighting system, for at least one of the first mode and the second mode control data is provided to at least one lighting device, which is advantageous.

In accordance with an embodiment of the lighting system, the first mode corresponds to switching on the lighting devices, the second mode corresponds to putting the lighting devices in standby, and the third mode corresponds to switching off the lighting devices, which is advantageous.

In accordance with an embodiment of the lighting system, the power and control data to each lighting device are provided via a respective common cable, which is advantageous as it economizes the infrastructure.

In accordance with an embodiment of the lighting system, power and control data to the lighting devices are provided via Ethernet with Power over Ethernet functionality, which is advantageous.

In accordance with an embodiment of the lighting system, power and control data to the lighting devices are provided via a power line with Power line communication, which is advantageous.

In accordance with an embodiment of the lighting system, each of the lighting devices comprises one of a light emitting diode "LED", a fluorescent lamp, a compact fluorescent lamp, a high-intensity discharge lamp "HID lamp". Thus, the present inventive concept is applicable for controlling lamp types with different startup characteristics.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

The below embodiments are provided by way of example so that this disclosure will be thorough and complete, and will fully convey the scope of the invention to those skilled in the art. Like numbers refer to like elements throughout.

Figure 1:
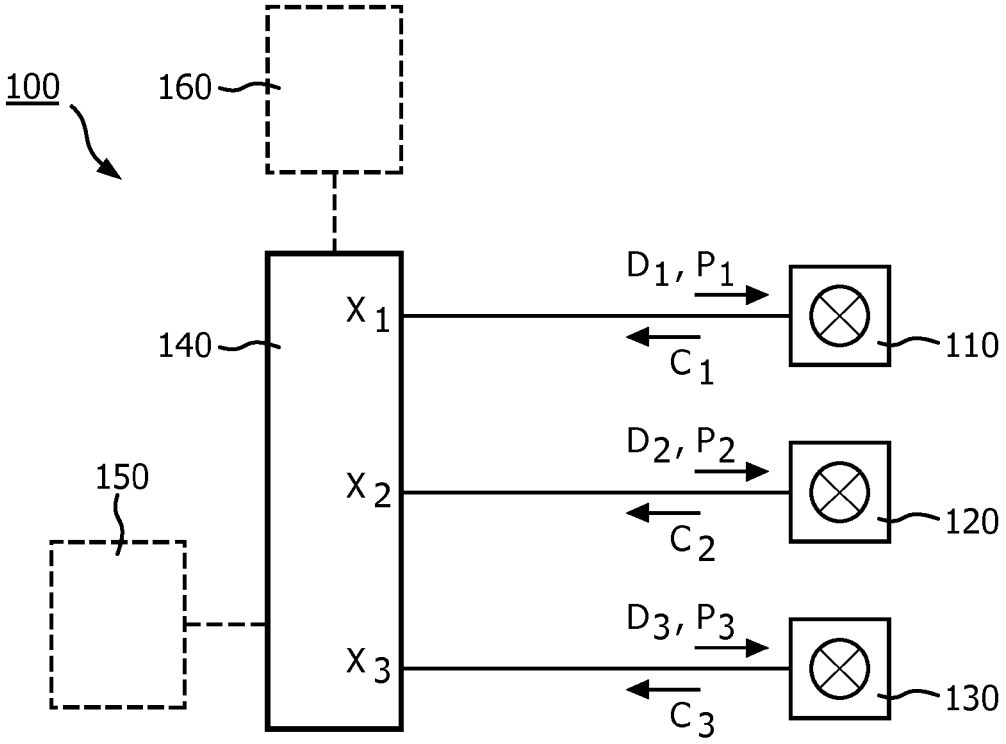
FIG. 1 is a schematic illustration of an embodiment of a lighting system according to the present invention.

FIG. 1 is a schematic illustration of a lighting system 100 according to an embodiment of the present invention. The lighting system 100 comprises a control unit 140 for providing at least power $P_{1,2,3}$ to f.i. three separate lighting devices 110, 120, 130. The lighting devices 110, 120, 130 are here installed in a working office located in an office building (not shown). Lighting device 110 is arranged for providing working light over a desk, while lighting devices 120 and 130 are arranged for providing background lighting of the office. Lighting device 110 comprises LEDs, and lighting devices 120 and 130 comprise Metal halide lamps. A Metal halide lamp is a type of high-intensity discharge (HID) lamp. Due to their individual type of light source, the startup characteristics $C_{1,2,3}$ of lighting device 110 and lighting devices 120, 130 are quite different. One dominating measure of the startup characteristics is the startup time for the light source. Taking the HID lamp of lighting device 120 as an example, a metal halide lamp which is cold, that is below operating temperature, cannot immediately begin producing its full light capacity. This is a consequence of the internal structure of the metal halide lamp, which produces light by passing an electric arc through a mixture of gases. The temperature and pressure in an inner arc chamber, which holds the gases, require time to reach full operating levels. The startup time of an initial argon arc sometimes takes a few seconds, and depending upon lamp type the warm up period of the lamp can be as long as five minutes. During this time the lamp exhibits different colors as various metal halides vaporize in the arc chamber. Further, for metal halide lamps the arc will extinguish if power is lost even temporarily. Restoring the arc is not be possible for some HID-lamps before a cool down period of several minutes has passed, due to the high pressure that exists in the hot arc tube. In addition, a warm lamp typically has a longer startup time before it reaches full brightness than a lamp which is started completely cold. Just the contrary of the HID lamp, a LED based lighting device has a very short startup time, as the LEDs light up very quickly. A typical LED will achieve full brightness in under a microsecond. Thus, the startup characteristic of a lighting device does not only relate to the dynamics of the light output and the corresponding current and voltage dynamics during start-up, but may also relate to for instance preheating dynamics of electrodes in order to prepare the lighting device for ignition or the cool-down time of a hot HID-lamp.

To continue, the control unit 140 is arranged as a gateway for the power supply of the lighting devices. The control unit 140 is arranged as an intelligent local intermediary switch connected to an external power source 150 (which is illustrated with dashed lines in FIG. 1). The control unit 140 further comprises circuitry for retrieving information regarding the individual lighting devices 110, 120, 130 according to at least one of the following embodiments:

According to an embodiment of the lighting system, the control unit 140 is arranged to retrieve the respective startup time for each lighting device 110, 120, 130 by means of measuring their respective startup time. The control unit 140 comprises a measurement unit (not shown) capable of detecting the startup time for lighting devices that are employed in the lighting system. This can be done e.g. by analyzing the power consumption at startup of the lighting devices. Other detection methods may be employed like for instance detecting the light from the lighting device during startup, which light is detected by means of a light sensor arranged in communication with the control unit (not shown). In an embodiment of the lighting system the measuring of the startup time and/or other startup characteristics for a lighting device is done as a commissioning step when the lighting device is installed, and/or may be done frequently with predetermined time intervals.

According to an embodiment of the lighting system, the control unit 140 is arranged to retrieve the startup characteristics by prompting each lighting device which is arranged to, with or without request, send startup characteristics data $C_{1,2,3}$ to the control unit 140. Hence, the lighting device itself contains data regarding its startup characteristics. This way any new lighting device which is installed in the lighting system can send its startup characteristics to the control unit. The startup characteristics data can be communicated directly in a suitable protocol format. Alternatively, the startup characteristics data is received by reference. Examples of such references are the MAC address of the device, which then can be used to retrieve the startup characteristics data from a data base, or by means of an URL which can be followed to get the startup characteristics data.

According to an embodiment of the lighting system, the control unit is arranged to retrieve the startup characteristics for each lighting device from an external source. The control unit 140 is in an embodiment of the lighting system connected to a managing computer 160 (which is illustrated with dashed lines in FIG. 1). The control unit 140 then prompts the managing computer 160 for a message comprising the startup characteristics of the lighting devices to which it is connected. Alternatively, direct commissioning by human action is possible. The commissioning can be assisted by a central data base with startup characteristics or via an URL. Alternatively, the complete lighting system plan may be available in the central managing computer 160 (e.g. the lighting design plan) and from the plan the control unit 140 can infer that, as an example, the lighting device 110 attached to port $x_1$ of the control unit is of type "fast switching".

A message comprising startup characteristics data may further be received from other entities in the system, and is communicated with messages that are constructed according to the applicable lighting protocol of the lighting system. Alternatively, a reference (e.g. URL) from where the characteristics can be retrieved can be integrated in the message.

Alternatively, the required startup characteristics are commissioned directly into the control unit by human action of a commissioner.

The measured or retrieved startup characteristics for the individual lighting device 110, 120, 130 are utilized in the control unit 140 to adapt the control logic accordingly. E.g. if it takes longer to start up a certain lighting device, the control unit will rather put that lighting device in standby then completely shutting it down. Other startup characteristics like e.g. appropriate ramping of the startup power may form part of the control logic for the individual lighting device. This way the control unit 140 manages the power of the lighting devices 110, 120, 130 independently of any higher level control logic at a higher level in the lighting system, such as at the managing computer 160.

To exemplify the control logic according to an embodiment of the lighting system, the following scheme is employed. The scheme is based on observed traffic, e.g. observation of humans present in a premises, and in addition a control logic employed in the control unit 140. Three different drive modes for the lighting devices 110, 120, 130 are employed: ON, STANDBY, and OFF. The first mode, ON, comprises switching the lighting devices 110, 120, 130 on. In this example the first mode is initiated by an alert, which is outputted from a motion detector connected to the lighting system (not shown). If a person enters the working office, the lights should immediately be switched on. If no one is present in the room, and it is during day time, more particularly within a first predetermined time setting, e.g. between 7 am and 7 pm, the second mode, STANDBY, is activated. In this mode, lighting devices are set in standby for two important reasons: to allow lighting devices to listen for upcoming control data, and to allow a fast switching into an on-state of the lighting device. The second mode is active as long as no one enters the working office. For the second mode, the settings on the respective lighting devices are selected based on the startup characteristics of the individual lighting device. When a person finally enters the working office this is detected by the motion detector as described above, and the first mode is hence activated. The first mode overrules the second mode, such that the lighting devices are switched on.

Further, if no one is present in the room, and it is afterhours, here defined with a second predetermined time setting, being between 7 pm and 7 am, the third mode, OFF, is activated. As is easily understood, the predetermined time settings described above may be set to any desired time settings and may be extended in quantity.

The control logic is further arranged such that for the first mode, ON, power $P_{1,2,3}$ is provided to each lighting device 110, 120, 130 lighting them all up. For the second mode, STANDBY, for lighting device 110, which is of LED type and thus has a short startup time, no power $P_1$ is provided. For lighting devices 120 and 130, which are of HID-type and thus has a longer startup time, a respective power level, $P_2$ and $P_3$, applicable for keeping the HID-lamps in a standby mode from which it takes a shorter time for initiating the arc, is provided. For the third mode, OFF, no power is provided to any of the lighting devices 110, 120, 130.

In an embodiment of the lighting system, for the first mode, ON, in addition to the power provided to the lighting devices, control data is provided to at least one lighting device. As an example the control logic of the control unit 140 is set to send control data $D_{1,2,3}$ comprising instructions for dimming the lighting device intensities to 75% of their full intensity values due to some daylight being present in the working office. The percentage of dimming and the daylight criterion may be entered as settings in the control logic. Alternatively, the system comprises at least one light detector for measuring the intensity of light present in the working office such that the dimming of the lighting devices may be calculated based on the detected light intensity. Control data may further comprise e.g. instructions for changing color temperature. Thus, depending on the type of the activity or time of the day the lighting system is arranged to e.g. early on the day provide colder activating light, or near closing time a warmer more relaxing light. Another example of control data is to provide instructions for task lighting depending on position of a user.

In an embodiment of the lighting system, the control unit 140 is arranged to receive power from an external power source 150, which is shown with dashed lines in FIG. 1. The external power source is in an embodiment simply the mains in a building, which is utilized to provide power to a number of lighting devices. Due to the digital commands of the control logic in control unit 140, the provided power is controlled and the lighting devices can be set to e.g. standby mode. In an alternative embodiment the external power source 150 is a standby power, which is activated when there is a mains failure.

Figure 2:
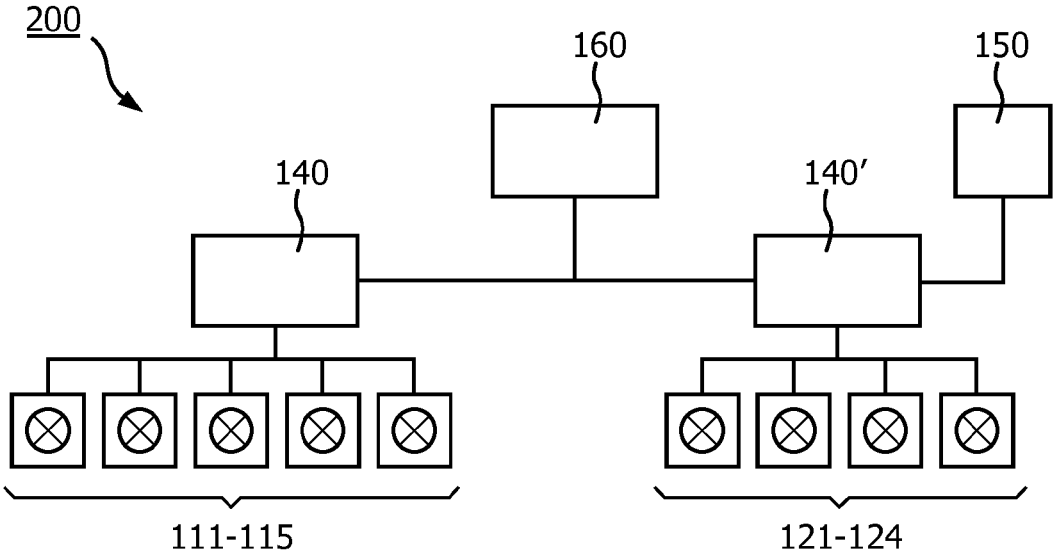
FIG. 2 is a schematic illustration of an embodiment of a lighting system according to the present invention.

In an embodiment of the lighting system 200, as illustrated schematically in FIG. 2, the preferences of the different drive modes are set up and controlled by an overall managing computer 160. That is, data which applies to the whole premises, which data may comprise e.g. information and logic settings to handle desired lighting settings of e.g. office hours, holidays, night lit areas, i.e. areas with a different predetermined time settings, can be controlled via the managing computer 160 (or central controller), while settings for the individual lighting devices, 111-115, and 121-124, in respective subareas of the premises, e.g. two departments, can be handled directly at an individual control unit 140, 140'. The control units 140, 140' are arranged as local intermediary switches, which communicate with the managing computer 160 for receiving the overall (higher level) logic settings. Here control unit 140' is further connected to an external power source 150 which is a standby power for providing emergency lighting in case of a mains failure.

According to an embodiment of the lighting system, referring now to FIG. 1, power $P_{1,2,3}$ and control data $D_{1,2,3}$ to the lighting devices 110, 120, 130 are provided via Ethernet with Power over Ethernet functionality (PoE). The Power over Ethernet standard (IEEE 802.3af) defines the interaction between power sources and loads. The loads are in this case the lighting devices. Data supplied via the Power over Ethernet cable are used to control driving properties of the lighting devices, and power is provided in accordance with the current control logic of the control unit 140. One Ethernet cable to each lighting device 110, 120, 130 thus transports both control data and power to the respective lighting device. As discussed above, the Ethernet cable may also be used to communicate when prompting or measuring startup characteristics $C_{1,2,3}$ for the lighting devices 110, 120, 130.

According to an embodiment of the lighting system, power and control data to the lighting devices are provided via a power line with Power line communication, which works in a similar way as described for the poE in the sense that control data and power to an individual lighting device can be delivered on one common cable.

Above, embodiments of the lighting system and method according to the present invention as defined in the appended claims have been described. These should be seen as merely non-limiting examples. As understood by a skilled person, many modifications and alternative embodiments are possible within the scope of the invention.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A lighting control system comprising a control unit and a managing computer arranged to provide control commands to at least one lighting device having a start-up time via the control unit, said at least one lighting device having a plurality of drive modes, wherein the control unit is arranged to adapt a control logic employed in the control unit for providing power to the at least one lighting device based on a respective length of the startup time of the at least one lighting device, said startup time being a startup characteristic of the at least one lighting device, wherein the control unit is configured to retrieve the respective length of the startup time for the at least one lighting device from an external source, and further configured to utilize the respective length of the startup time for the at least one lighting device to adjust the power provided to the at least one lighting device in said plurality of drive modes.

2. The lighting control system according to claim 1, wherein said control unit is further arranged for providing control data to each lighting device, and wherein said control logic is further arranged for controlling said control data.

3. The lighting control system according to claim 1, wherein said control unit is arranged to receive power from an external power source.

4. The lighting control system according to claim 1, wherein said control unit is arranged to retrieve the respective startup time for each lighting device by means of measuring the startup time of each lighting device.

5. The lighting control system according to claim 1, wherein the respective startup time for each lighting device is retrieved by prompting each lighting device, or by retrieving said respective startup time for each lighting device from an external source.

6. The lighting control system according to claim 1, wherein when retrieving the respective startup time for each lighting device from an external source, said lighting control system is arranged to receive a message comprising the respective startup time, which message is constructed according to a lighting protocol, or said lighting control system is arranged to receive a message comprising a reference to a location where the respective startup time can be retrieved.

7. The lighting control system according to claim 1, wherein said control logic is arranged for, if said control unit receives an alert, switching each lighting device into a first drive mode, or if a predetermined first time setting is satisfied switching each lighting device into a second drive mode, or if a predetermined second time setting is satisfied switching each lighting device into a third mode.

8. The lighting control system according to claim 7, wherein said control logic is further arranged such that:

for said first mode power is provided to each lighting device;

for said second mode and for each lighting device having a first type of startup characteristics no power is provided to that lighting device;

for said second mode and for each lighting device having a second type of startup characteristics at least some power is provided to that lighting device; and for said third mode no power is provided to each lighting device.

9. The lighting control system according to claim 8, wherein for at least one of said first mode and said second mode control data is provided to at least one lighting device.

10. The lighting control system according to claim 8, wherein said first mode corresponds to switching on said lighting devices, said second mode correspond to putting said lighting devices in standby, and said third mode corresponds to switching off said lighting devices.

11. The lighting control system according to claim 8, wherein the power and control data to each lighting device are provided via a respective common cable.

12. The lighting control system according to claim 8, wherein power and control data to said lighting devices are provided via Ethernet with Power over Ethernet functionality.

13. The lighting control system according to claim 8, wherein power and control data to said lighting devices are provided via a power line with Power line communication.

14. The lighting control system according to claim 8, wherein each of the lighting devices comprises one of a light emitting diode "LED", a fluorescent lamp, a compact fluorescent lamp, a high-intensity discharge lamp "HID lamp".

15. A lighting system comprising the lighting control system and each lighting device according to claim 8.

* * * * *